US005390603A

United States Patent [19]

Hauck et al.

[11] Patent Number: 5,390,603

[45] Date of Patent: Feb. 21, 1995

[54] METHOD FOR AUTOMATIC CHANGING OF PRINTING PLATES

[75] Inventors: Dieter Hauck, Eberbach; Robert Müller, Mörlenbach; Jürgen Reithofer, Nussloch, all of Germany

[73] Assignee: Heidelberger Druckmaschinen AG, Heidelberg, Germany

[21] Appl. No.: 78,407

[22] Filed: Jun. 17, 1993

[30] Foreign Application Priority Data

Jun. 17, 1992 [DE] Germany ..... 4219870

[51] Int. Cl.[6] ..... B41F 27/06

[52] U.S. Cl. ..... 101/485; 101/477

[58] Field of Search ..... 101/477, 415.1, 409, 101/410, 485, 378

[56] References Cited

U.S. PATENT DOCUMENTS 4,581,993 4/1986 Schóneberger .
5,076,165 12/1991 Pollich .
5,167,186 12/1992 Honkawa et al. ..... 101/415.1

FOREIGN PATENT DOCUMENTS 0435413 7/1991 European Pat. Off. .
3342662 6/1985 Germany .
3936459 4/1991 Germany .
4013003 10/1991 Germany .
3918128 10/1992 Germany .

*Primary Examiner*—J. Reed Fisher
*Attorney, Agent, or Firm*—Herbert L. Lerner; Laurence A. Greenberg

[57] ABSTRACT

A method for automatically changing printing plates for a printing machine is disclosed. The machine has a plurality of printing cylinders for mounting the printing plates, wherein each printing cylinder has a respective side register. The method comprises: driving a first printing cylinder to a printing plate release position; releasing the trailing edge of the old printing plate; turning the printing cylinder in a direction for unwinding the old printing plate; stopping the printing machine in a printing plate release position of another printing cylinder; releasing the old printing plate of the other printing cylinder; turning the printing machine in a direction for unwinding the old printing plate; repeating foregoing steps until all old printing plates are released and are connected at their respective leading edges; turning the printing machine in a direction for on-winding new printing plates; stopping the printing machine in a printing plate feed-in position of a first printing cylinder; feeding-in a first new printing plate to the first printing cylinder, and clamping onto the printing cylinder the first new plate; repeating foregoing steps until all new printing plates have been clamped onto a respective printing cylinder; and zero-setting the side register for each printing cylinder before feeding-in the new printing plate.

11 Claims, 3 Drawing Sheets

METHOD FOR AUTOMATIC CHANGING OF PRINTING PLATES

SPECIFICATION

The invention relates to a method for automatic changing of printing plates in a printing machine having a plurality of printing plate cylinders for mounting of respective printing plates, wherein a first printing plate cylinder is driven to a printing plate release position, a trailing edge of the printing plate of the printing plate cylinder is released, and wherein next the printing machine is turned in the printing plate unwinding direction, the printing machine is stopped when a second printing plate cylinder is in the release position, in order to release that printing plate, and so on, until all the printing plate trailing edges are released, the printing plates unwound, their leading edges released and removed, and wherein next the printing machine is turned in the opposite unwinding direction and stopped in a printing plate feed-in position of a first printing plate cylinder in order to feed-in the first new printing plate, and continue turning the machine in the plate unwinding direction until a second printing plate cylinder is in its printing plate feed in position, again stopping feeding-in the printing plate, and again turning the printing machine and so on until all printing plates have been fed in, mounted on the respective printing plate cylinder, and with their trailing edges clamped in their respective positions.

Such a method is known from EP 0 435 413. It is applicable to printing machines wherein the printing plate cylinders have different angular positions, so that accordingly only one cylinder at the time is in the release or in the clamping position. With this method it is a problem that the old printing plates from the previous printing job are still on the printing cylinders, and not in the zero position in regard to the side register. The side register could be more or less mispositioned i.e. off-set from the previous printing job according to the printing plate's quality. For adjusting the side register, the printing plate cylinder is shifted sideways, so that it could be mispositioned by up to two millimeters to the left or right of the zero position. For insertion of the new printing plates there are register bolts at the leading printing plate edges clamping position which fit in U-shaped cut-outs in order to position them in their proper positions.

In the case that the plate cylinder is offset in side register an amount from the zero position which is not negligible, from the previous printing job, it can happen that a new printing plate cannot be fitted in, since the U-shaped cut-out in the new printing plates are out of alignment with the register bolts. Elimination of the register bolts is, however, not an acceptable solution, due to imprecise positioning, and since only a printing cylinder positioned in its zero position of the side register is capable of assuming the maximum correction to both sides. It would therefor also, in that case be necessary, using a printing plate cylinder without register bolts, to reset the side register to its zero position, in order to be able to adjust the printing plate a sufficient distance to both sides.

It is accordingly the object of the method according to the invention to modify the method described above such that, after feeding in a new printing plate, a full side register correction can be made to both sides, and wherein further a positioning system with register bolts can be used.

This object is attained, in accordance with the inventive concept, such that in a method as described above, each printing plate cylinder is reset to its side register zero position before a new printing plate is clamped in.

Depending upon the particular realization of the printing plate control arrangement it may also be necessary to reset the old printing plate to the side register zero position before releasing the old printing plate, in order to, for example, insure a precise insertion of a printing plate, to be reused, in a cassette.

The method can be realized in different ways, for example: The printing plate cylinder is first driven to its zero position, in order to subsequently select and perform a clamping procedure on the printing plate, i.e. selecting either a mounting procedure, or if required, performing a release procedure in case of an old printing plate, in other words, selecting the procedure for the plate which requires the shortest angular positioning distance of the printing cylinder in order to reach the clamping and/or release position.

It is, however, also possible to first select the individual printing plate cylinder for the clamping and/or release procedure such that, for the selected printing plate cylinder, the total time is computed for reaching the clamping and/or release position, for reaching the zero position of the side register of the selected printing plate cylinder and selecting that printing plate cylinder which first reaches the zero position of the side register and the clamping and/or release position in regard to the angular positioning of the cylinder.

The selection of the one or the other method as applied to the first plate cylinder is repeated exactly for all the other plate cylinders. In other words, as criteria for selecting the sequence of the cylinders, either the most suitable angular position of the printing plate cylinder can be used, or the shortest possible time for reaching both the clamping, and/or the release position, and the zero position of the side register.

If it is required, for feeding-in the printing plate, to first reach the zero position of the side register, then the best angular position for removing the printing plate is used, and the best time for reaching the clamping and/or release position and for reaching the zero position of the side register, and for inserting the new printing plate, is used. In this case it is also possible to perform the positioning of the side register at the time of removal of the old printing plate.

In general, however, the mechanics of removing the old printing plate does not offer sufficient tolerance to allow the side adjustment of the printing plate cylinder to be performed during the removal of the old printing plate. In this case the zero-setting of the side register must be performed during the time when the plate is fed in, except during the time the leading edge of the old printing plate is loosened, the old printing plate is unwound and until loosening the trailing edge of the printing plate. Accordingly, the time available for the side register zero setting is reduced to the time for reaching the position for releasing the old printing plate, and, if by this time the zero position has not been reached, also the time from releasing the trailing edge of the old printing plate until reaching the angular position wherein the leading edge of the new plate is in position for clamping.

This method can be expanded to printing machines having also register adjustment for diagonal registration. Such correction is necessary when the image to be printed has a slanted offset, i.e. an offset wherein the image has an angular deviation from proper registration.

Such a slanted register correction can be performed by slanting the axis of the plate cylinder or by using a device, by means of which the printing plate is set at a slant relative to the plate cylinder.

In this case the method operates as follows:

The printing plate cylinder is first set to the zero position of the side register and the diagonal register, and next the sequence of printing cylinders is selected so that the cylinder having the most advantageous angular position of the printing plate cylinder is selected first.

It is however, also possible to select the sequence of the clamping and/or release steps such that the best computed time is attained in reaching the clamping and/or release position, reaching the side register zero position, and reaching the zero position of the diagonal register. The sequence of the clamping and/or release steps depends then on which one of the printing plate cylinders that first reach these adjustments. As the criterion for the shortest possible time for reaching the clamping and release position, the zero position of the side register and the zero position for the diagonal register can be determined by their deviation from the corresponding positions of the old printing plates, if these criteria are, for example, required for the automatic plate changing arrangement, or for a need for precise insertion of old printing plates in a cassette; alternatively, it is possible to base the time criterion on the feeding-in of new printing plates. In the latter case the deviation of the angular position of the old printing plates from the best position is used as the criterion for the shortest positioning distance for sequencing of the various steps.

For the diagonal register it can also happen that the mechanisms for removal of the old printing plate have tolerances, i.e. deviations of the plates, that are not sufficient to allow axial resetting of the printing plate cylinder, or resetting of the diagonal register. Also, in this case is it necessary to reset the diagonal register to zero position during the time while the new plate is being fed-in, however, from this time the time duration required for loosening the leading edge of the old printing plate, for unwinding the printing plate and for loosening the trailing edge of the printing plate must be subtracted. In this case, it follows that the available time is limited to the time for zero setting the diagonal register, the positioning distance required for the printing plate cylinder to reach the position for releasing the old printing plate, and, if at this time, the zero position of the diagonal register has not been reached, it is further required to add the positioning distance from the releasing of the trailing edge of the old printing plate until reaching the position for clamping on the leading edge of the new printing plate.

In view of the foregoing there is provided, in accordance with the invention a method for automatically changing printing plates for a printing machine having a plurality of printing cylinder for mounting the printing plates, wherein each printing cylinder has a respective side register, the method which includes the steps of:

(a) driving a first printing cylinder to a printing plate release position;
(b) releasing the trailing edge of the old printing plate;
(c) turning the printing cylinder in direction for unwinding the old printing plate;
(d) stopping the printing machine in a printing plate release position of another printing cylinder;
(e) releasing the old printing plate of the other printing cylinder,
(f) turning the printing machine in direction for unwinding the old printing plate;
(g) repeating steps (d), (e) and (f) until all old printing plates are released and are connected at their respective leading edges;
(h) turning the printing machine in direction for onwinding new printing plates;
(i) stopping the printing machine in printing plate feed-in position of a first printing cylinder;
(j) feeding-in a first new printing plate to the first printing cylinder of step (i), and clamping onto the printing cylinder the first new plate;
(k) repeating steps (h), (i) and (j) until all new printing plates have been clamped onto a respective printing cylinder; and
(l) zero-setting the side register for each printing cylinder before feeding-in the new printing plate.

Another feature of the invention includes the step of zero-setting the side register for each printing plate before releasing the old printing plate.

In accordance with a further feature, the invention includes the step of selecting the respective sequence of printing cylinders for releasing the old printing plates and feeding-in the new printing plates such that each printing cylinder having the smallest rotary angle to the respective release and/or feed-in position is selected first.

In accordance with an added feature, the invention includes the step of selecting the respective sequence of printing cylinders for releasing the old printing plates and feeding-in the new printing plates such that each printing cylinder having the shortest travel time reaching the respective release and/or feed-in position and for zero-setting the respective printing cylinder is selected first.

In accordance with an additional feature, the invention includes the step of selecting the printing cylinders for releasing the old printing plates such that each printing plate having the smallest rotary angle for reaching the respective release position is selected first, and selecting the sequence for mounting the new printing cylinders such that each printing cylinder having the shortest time for reaching the feed-in position and the shortest time for zero-setting the respective side register is selected first.

In accordance with yet another feature, the invention includes the step of zero-setting the respective side register of a printing cylinder during the time required for mounting the new printing plate less the time required for releasing the old printing plate.

In accordance with yet a further feature of the invention, wherein the printing machine has at least one printing cylinder equipped with a diagonal register, the method further includes the step of zero-setting the diagonal register before mounting a printing plate on the printing cylinder.

In accordance with yet an added feature of the invention, wherein the printing machine has at least one printing cylinder equipped with a diagonal register, the method further includes the step of zero-setting the diagonal register before releasing a printing plate from the printing cylinder.

In accordance with yet an additional feature of the invention, the printing machine has a plurality of printing cylinders, each equipped with a respective diagonal register, wherein the method further includes the step of determining for each cylinder the time lapse required for reaching the plate mounting position, for zero-setting the side register and zero-setting the diagonal register, and selecting in sequence first the printing cylinder having the shortest time lapse.

In accordance with still a further feature of the invention, wherein said printing machine has a plurality of printing cylinders each equipped with a respective diagonal register, the method further includes the step of determining for each cylinder the shortest angular rotation required for reaching the printing plate release position, and next determining the shortest elapsed time required for zero-setting the side register and zero-setting the diagonal register, and selecting the sequence for mounting the printing plates on the respective printing cylinders in accordance with the determined elapsed times.

In accordance with a concomitant feature of the invention, wherein the printing machine has a plurality of printing cylinders each equipped with a diagonal register, the method further includes the step of zero-setting the side register during the time available for mounting a new printing plate less the time required for releasing the old printing plate.

DESCRIPTION OF THE PREFERRED EMBODIMENTS

Figure 1:
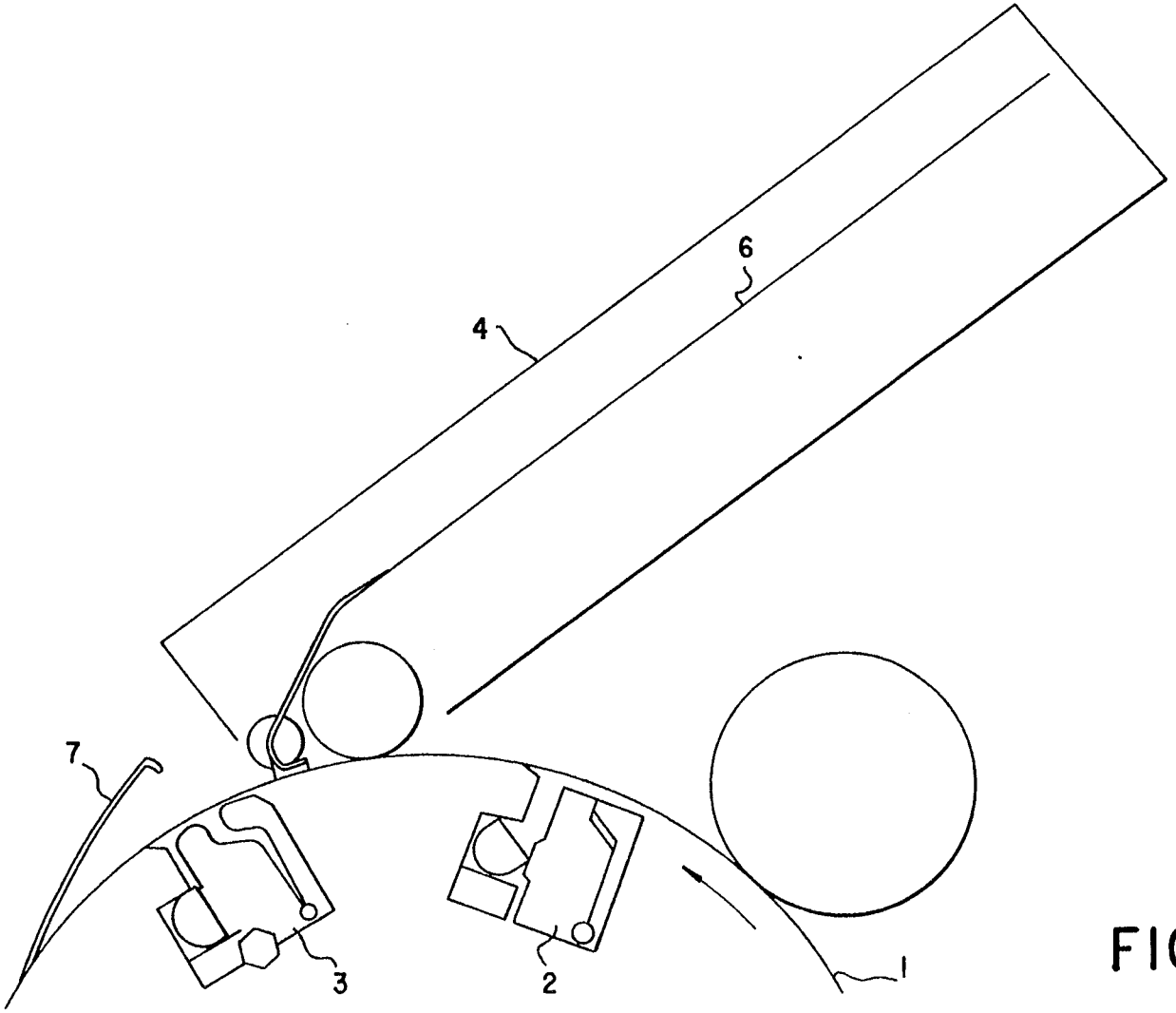
FIG. 1 is a diagrammatic end view of a printing cylinder showing plate clamping devices and a plate cassette.

In FIG. 1 a printing cylinder 1 has two plate locking devices, of which 2 is a leading edge locking device for locking a leading edge of a printing plate, and 3 is a trailing edge plate locking device. A cassette 4 holds a new printing plate 6 ready to be mounted on the printing cylinder 1, while an old plate 7 has just been released at its trailing edge from the trailing edge locking device 3.

Figure 2:
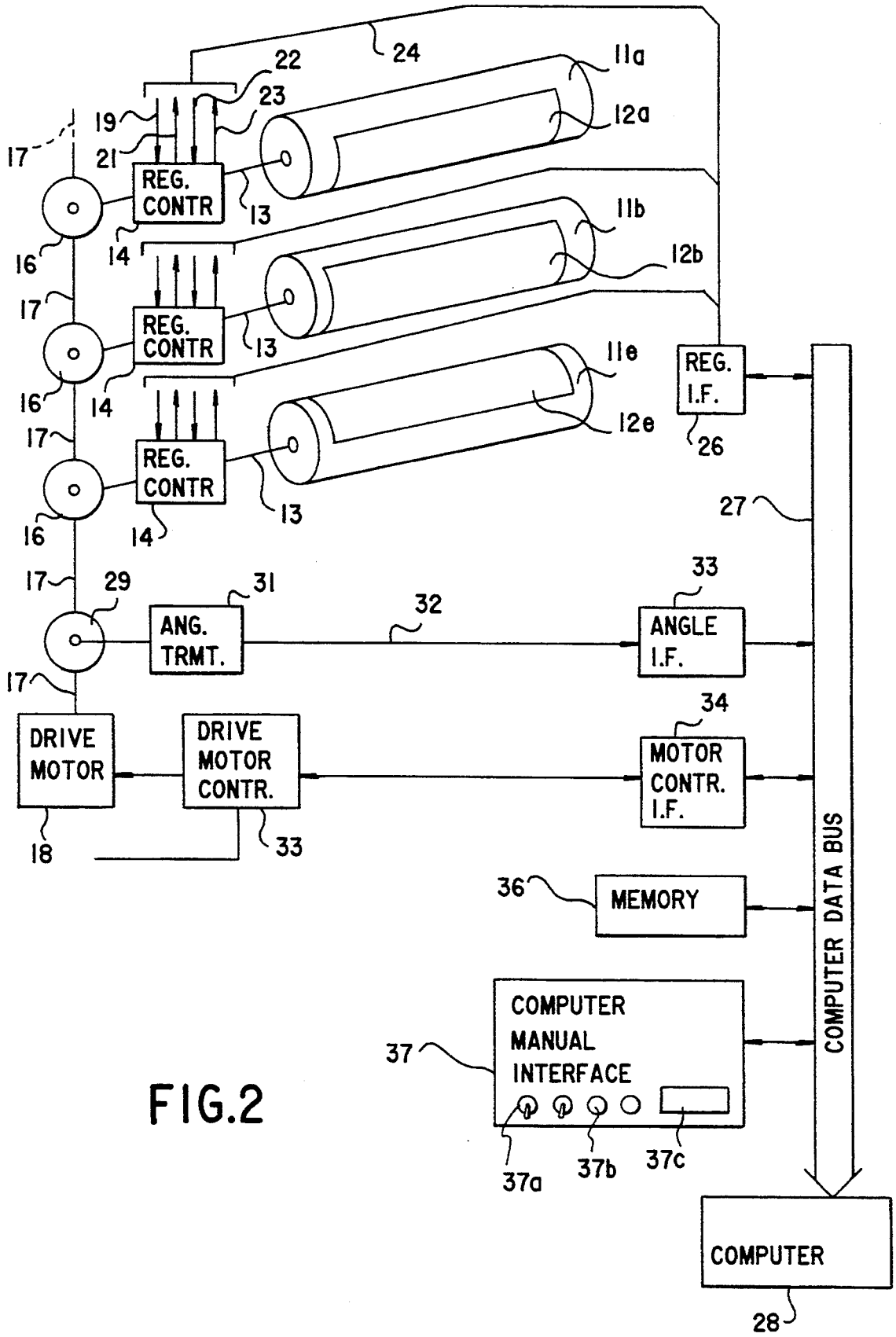
FIG. 2 is a system block diagram of a part of a printing machine showing some of the printing cylinders, the drive elements, and the control system.

FIG. 2 is a diagrammatic view of a part of a printing machine showing three printing cylinders 11*a*, 11*b* and 11*c*, each having a respective printing plate 12*a*, 12*b* and 12*c* mounted thereon. Each cylinder has a cylinder shaft 13 connected via a register control arrangement 14, via a transmission 16 to a common drive shaft 17, which is driven by a common drive motor 18 which drives the printing machine including the printing cylinders 11*a*, 11*b* and 11*c*.

Each cylinder 11*a*, 11*b* and 11*c* is equipped with at least a side register arrangement, not shown in more detail, which is capable of adjusting the cylinder in an axial direction for the purpose of aligning the printed images imprinted on the printing material, not shown, in their respective ink colors. Optionally each cylinder may also be equipped with a so-called diagonal register, which operates to turn the printing plate about an axis perpendicular to the axis of the cylinder in order to provide angular alignment between the printed images printed by each cylinder. The registers, which are well known and conventional are each controlled and monitored by the register control 14. Each register control 14 is connected via four control leads 19, 21, 22 and 23 with a register control bus 24, which is connected via a register interface circuit 26 to a control computer 28 via a computer data bus 27. The control leads to the register control 14 include a side register position set lead 19 which signals to the register control 14 the desired position to which the side register is to be set, a side register monitor lead 21 which signals the computer the actual position of the side register. Lead 22 is a diagonal register position set lead which signals to the register control 14 the desired position to which the diagonal register is to be set, and a diagonal register monitor lead 23, which signals the computer 28 the actual position of the diagonal register. The other printing cylinders 11*b* and 11*c* are similarly equipped with a register control 14, having similar control leads connected via register control bus 24 to the computer 28. The common drive shaft 17 is connected via a coupling 29 to an angle transmitter 31, which transmits in sufficiently fine angular increments the angular position of the drive shaft 17 via angular position lead 32 to the angle interface 33, connected to the computer data bus 27. The angle transmitter 31, transmits also in positive or negative increments the direction of rotation of the drive shaft, so that the computer 28 is at all times informed of the angular position of the drive shaft 17. The transmissions 16 are slip-fee transmission so that accordingly the angular position of all printing cylinders 11*a*, 11*b* and 11*c* is "known" to the computer 28, also at all times.

The drive motor 18 is controlled by a drive motor control 33 which is connected via a motor control interface 34, and via computer data by 27 to the computer 28. The drive motor control 33 allows the computer to control the speed and direction of rotation of the motor 18 and hence the drive shaft 17. A computer memory 36, connected to the computer 28 via computer data bus 27, serves to store all control programs for performing the invention and normally also other programs for performing other tasks required for operating a printing machine. A computer manual interface 37 is equipped with all control keys 37*a*, signal lights 37*b*, and displays 37*c* required for controlling the printing machine and monitoring its operation. The manual interface 37 allows the machine operator to control the printing machine and, in particular enables the operator to set any printing cylinder to any desired angular position, such as the positions for mounting and releasing a printing plate, turning the cylinder in either direction at any speed as required for mounting and releasing the printing plates. The manual interface 37 enables the machine operator to position the side and diagonal registers via the register controls 14, and to zero-set the registers when required. It follows that the memory 36 may contain information that at all times enables the computer 28 to determine the angular distance and direction of any printing cylinder in relation to a fixed position such as the plate mounting and release positions, and to determine the direction of rotation and the angle of rotation that is the most advantageous choice in rotating a cylinder to one of the fixed positions. Since register position information is also available in the memory, it is possible for the computer to determine the time required to set a register to a given position and, the time required to zero-set the registers. In this manner it is possible to determine by the computer the best sequence for selecting the cylinders for releasing, for example, old printing plates and mounting new printing plates for a new printing job. With this information the normally long and tedious procedure of changing printing plates for a new printing job is significantly reduced, leading to a better utilization of the printing machine.

Figure 3:
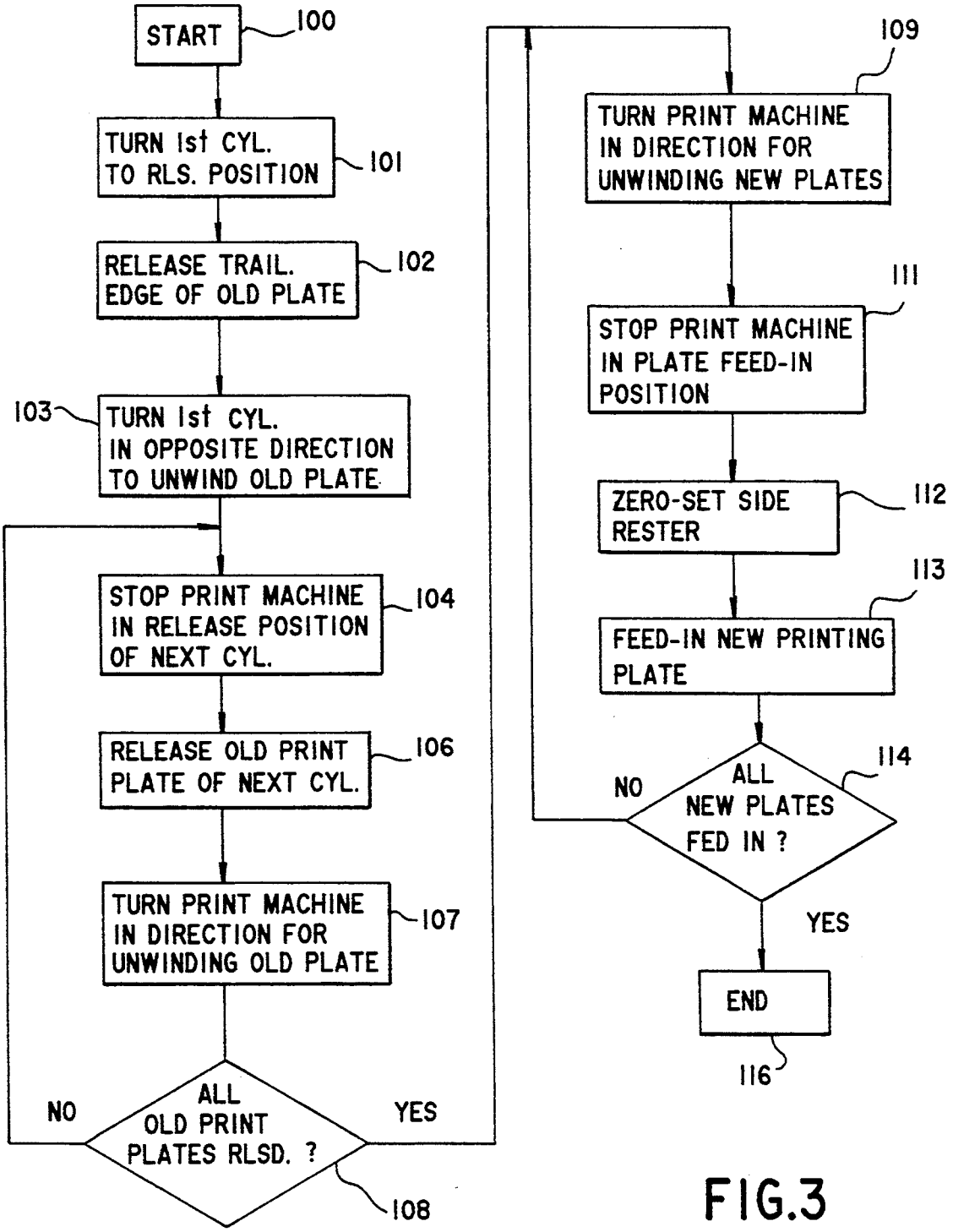
FIG. 3 is a flow chart showing the major steps in the method according to the invention.

FIG. 3 is a flow chart showing the major steps to be performed in practicing the method according to the invention. In order to perform a plate changing job, the computer determines as described above the best sequence of releasing the old printing plates, and mounting the new printing plates based on the known angular position of each cylinder in relation to the positions for releasing the old plates and mounting the new plates and taking into account the time for zero-setting the registers. The selected sequence determines the first cylinder listed in the flow chart, the next cylinder, and so forth.

In FIG. 3 after start 100, the first cylinder selected is turned in a first direction to its plate release position (step 101), the trailing edge of the old plate is released (step 102), the first cylinder is next turned in opposite direction to unwind the old printing plate (step 103); after unwinding the printing plate the printing machine is stopped at the plate release position of the next cylinder in the selected sequence (step 104). Next the old printing plate is released from the next cylinder (step 106), and the printing machine is again turned in direction for unwinding th old plate (step 107). In decision step 108 it is determined if all old printing plates have been removed. If not, steps 104, 106 and 107 are repeated until all old printing plates have been released. Next, in step 109 the printing machine is turned in direction for on-winding the first new plate of the cylinder selected as the first cylinder to receive a new plate, in step 111 the machine is stopped in the position for feeding-in the new plate of the firs selected cylinder. Next the side register for that plate is set to zero in step 112, and the first new printing plate is fed in (step 113). Steps 109, 111, 112 and 113 are repeated until all plates are fed-in as determined in decision step 114, after which the plate changing procedure is completed in step 116.

It follows that, if necessary, the zero-setting of the side register can be performed, for example, between steps 101 and 102 in order to allow the released plate to enter a cassette for storage.

We claim:

1. Method for automatically changing printing plates for a printing machine having a plurality of printing cylinders for mounting the printing plates, wherein each printing cylinder has a respective side register, the method which comprises the steps of:

(a) driving a first printing cylinder to a printing plate release position;

(b) releasing the trailing edge of the old printing plate;

(c) turning the printing cylinder in direction for unwinding the old printing plate;

(d) stopping the printing machine in a printing plate release position of another printing cylinder;

(e) releasing the old printing plate of the other printing cylinder, (f) turning the printing machine in direction for unwinding the old printing plate;

(g) repeating steps (d), (e) and (f) until all old printing plates are released and removed from all printing cylinders;

(h) turning the printing machine in direction for on-winding new printing plates;

(i) stopping the printing machine in printing plate feed-in position of a first printing cylinder;

(j) feeding-in a first new printing plate to the first printing cylinder of step (i), and clamping onto the printing cylinder the first new plate;

(k) repeating steps (h), (i) and (j) until all new printing plates have been clamped onto a respective printing cylinder; and (l) zero-setting the side register for each printing cylinder before feeding-in the new printing plate.

2. Method according to claim 1, comprising the step of zero-setting the side register for each printing plate before releasing the old printing plate.

3. Method according to claim 1, comprising the step of selecting the respective sequence of printing cylinders for releasing the old printing plates and feeding-in the new printing plates such that each printing cylinder having the smallest rotary angle to the respective release and/or feed-in position is selected first.

4. Method according to claim 2, comprising the step of selecting the respective sequence of printing cylinders for releasing the old printing plates and feeding-in the new printing plates such that each printing cylinder having the shortest time for reaching the respective release and/or feed-in position and for zero-setting the respective printing cylinder side register.

5. Method according to claim 2, comprising the step of selecting the printing cylinders for releasing the old printing plates such that each printing plate having the smallest rotary angle for reaching the respective release position is selected first, and selecting the sequence for mounting the new printing cylinders such that each printing cylinder having the shortest time for reaching the feed-in position and the shortest time for zero-setting the respective side register is selected first.

6. Method according to claim 5, comprising the step of zero-setting the respective side register of a printing cylinder during the time required for mounting the new printing plate less the time required for releasing the old printing plate.

7. Method according to claim 1, wherein the printing machine has at least one printing cylinder equipped with a diagonal register, further comprising the step of zero-setting the diagonal register before mounting a printing plate on the printing cylinder.

8. Method according to claim 1, wherein the printing machine has at least one printing cylinder equipped with a diagonal register, further comprising the step of zero-setting the diagonal register before releasing a printing plate from the printing cylinder.

9. Method according to claim 1, wherein the printing machine has a plurality of printing cylinders, each equipped with a respective diagonal register, further comprising the step determining for each cylinder the time lapse required for reaching the plate mounting position, for zero-setting the side register and zero-setting diagonal register, and selecting in sequence first the printing cylinder having the shortest time lapse.

10. Method according to claim 1, wherein the printing machine has a plurality of printing cylinders each equipped with a respective diagonal register, further comprising the step of determining for each cylinder the shortest angular rotation required for reaching the printing plate release position, and next determining the shortest elapsed time required for zero-setting the side register and zero-setting the diagonal register, and selecting the sequence for mounting the printing plates on the respective printing cylinders in accordance with the determined elapsed times.

11. Method according to claim 1, wherein the printing machine has a plurality of printing cylinders each equipped with a diagonal register, further comprising the step of zero-setting the side register during the time available for mounting a new printing plate less the time required for releasing the old printing plate.

* * * * *